United States Patent [19]

Cloud et al.

[11] 4,441,660

[45] Apr. 10, 1984

[54] APPARATUS FOR AUTOMATICALLY DOFFING YARN PACKAGES AND DONNING EMPTY BOBBINS ON A WINDER

[75] Inventors: Nathan Cloud, Wilmington; Robert A. Marin, Newark; James E. McErlane, Wilmington, all of Del.

[73] Assignee: E. I. du Pont de Nemours and Company, Wilmington, Del.

[21] Appl. No.: 382,768

[22] Filed: May 27, 1982

[51] Int. Cl.[3] ..... B65H 67/04

[52] U.S. Cl. ..... 242/35.5 A

[58] Field of Search ..... 242/35.5 A, 35.5 R, 242/35.6 R, 18 A, 18 R

[56] References Cited

U.S. PATENT DOCUMENTS

| | | | |
|---|---|---|---|
| 2,789,774 | 4/1957 | Petersen et al. | 242/18 A |
| 3,310,247 | 3/1967 | Emery | 242/18 A |
| 3,791,126 | 2/1974 | Kose et al. | 242/35.5 A |
| 3,811,631 | 5/1974 | Mayer et al. | 242/35.5 A X |
| 3,820,730 | 6/1974 | Endo et al. | 242/35.5 A |
| 3,964,723 | 6/1976 | Schippers et al. | 242/35.5 A |
| 3,971,520 | 7/1976 | Shimai | 242/35.5 A |
| 4,023,743 | 5/1977 | Schippers | 242/35.5 A |
| 4,125,990 | 11/1978 | Stahlecker et al. | 242/35.5 A X |
| 4,171,779 | 10/1979 | Kamp | 242/35.5 A |
| 4,335,859 | 6/1982 | Courvoisier | 242/35.5 A |

*Primary Examiner*—Stanley N. Gilreath

[57] ABSTRACT

A power-driven, wheeled vehicle which interacts automatically with winders in a spinning area to doff completed yarn packages, insert empty bobbins on standby chucks of the winder, deliver the packages to an overhead powered conveyor to place the winder in condition for another cycle and to move to another winder to repeat the operations.

2 Claims, 11 Drawing Figures

32
31
33
3
42
39
36
26
36
36a
5
54
37
40
41
34
5
56
35
28
25
29
27
30
27
28a
27
3

77
75a
54
75
76
78
55
72
73
74
66
71
67
68
57
56
81
84
80
82
79
55
70
25
65
83

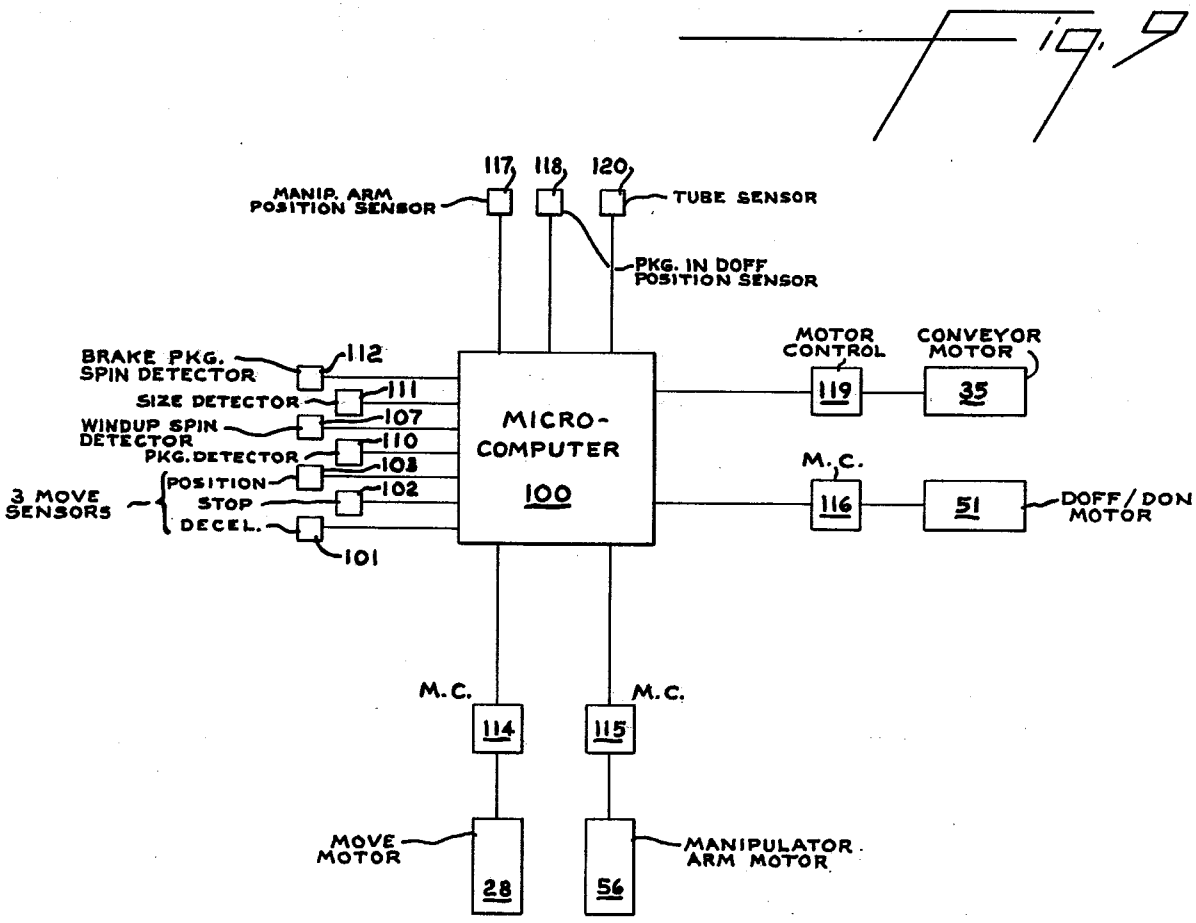
TUBE SENSOR
PKG. IN DOFF POSITION SENSOR
MANIP. ARM POSITION SENSOR
120
118
117
MICRO-COMPUTER
100
MOTOR CONTROL
119
CONVEYOR MOTOR
35
M.C.
116
DOFF/DON MOTOR
51
M.C.
115
MANIPULATOR ARM MOTOR
56
M.C.
114
MOVE MOTOR
28
112
111
107
110
108
102
101
BRAKE PKG. SPIN DETECTOR
SIZE DETECTOR
WINDUP SPIN DETECTOR
PKG. DETECTOR
POSITION
STOP
DECEL.
3 MOVE SENSORS

APPARATUS FOR AUTOMATICALLY DOFFING YARN PACKAGES AND DONNING EMPTY BOBBINS ON A WINDER

BACKGROUND OF THE INVENTION

This invention relates generally to the packaging of synthetic yarn and more particularly to an improved apparatus for automatically doffing the equipment with which yarn advancing continuously from a source is wound on successive packages.

The doff-don servant of this invention generally is a power-driven, wheeled vehicle which interacts automatically with winders in a spinning area to doff completed yarn packages, insert empty bobbins on standby chucks of the winder, deliver the packages to an overhead powered conveyor, place the winder in position for another cycle and to move to another winder to repeat the operations.

The winders are of the type described in U.S. Pat. No. 2,789,774, with a yarn transfer mechanism of the type described in U.S. Pat. No. 3,310,247. The winder has double articulated arms which carry two bobbins alternately into surface driven contact with a drive roll. At the time of doff, the yarn transfer mechanism and deflector swings pneumatically to a position under the drive roll and under the standby (empty) bobbin where the mechanism effects transfer of the running yarn to the empty bobbin. In this operation, the yarn-carrying chuck and arms fall to a rest position where the chuck and package are braked. After subsequent (formerly manual) manipulation of arms and package for doffing and donning at a doff-don position, the double arm and chuck are rotated about 180° to a park position above but out of contact with the drive roll in readiness for the next cycle.

SUMMARY OF THE INVENTION

While doff-don units are known for servicing various types of winders none provide the positive interaction with the winder as provided by the instant invention which in combination with a winding apparatus having a plurality of windups, each windup including a drive roll, a pair of rotatable chucks alternately movable from a park position into surface driven engagement with the drive roll then to a rest position, including a pair of articulated swing arms mounted to the windup for moving the chucks through said positions, comprises (a) a frame mounted for movement into a position adjacent each windup;

(b) a gripper to engage said swing arms on the windup when in the rest position;

(c) means connecting the gripper and the frame for moving the gripper into engagement with said arms and moving the gripper and swing arms from the rest position to a doff-don position then to said park position;

(d) means attached to said frame at a location adjacent said doff-don position for doffing yarn packages from the chuck and donning empty bobbins thereon following doffing when the swing arms are in the doff-don position; and (e) endless conveyor means attached to said frame for delivering doffed yarn packages from said doff-don position to a location away from said winder and for delivering empty bobbins to said doff-don position for placement on said chucks by said means for donning bobbins.

BRIEF DESCRIPTION OF THE DRAWINGS

FIG. 9 is a block diagram of the control features of the doff-don servant.

DETAILED DESCRIPTION OF THE PREFERRED EMBODIMENT

Figure 1:
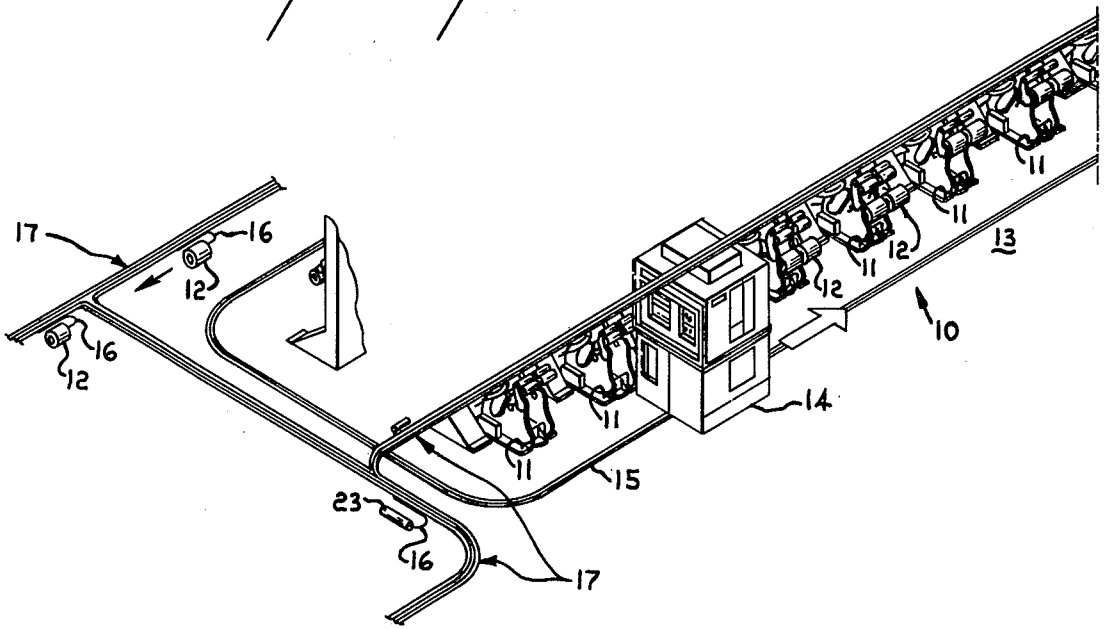
FIG. 1 is an isometric diagram of a spinning area showing a doff-don servant adjacent to a winder and showing an overhead conveyor network for carrying yarn packages to a package handling area away from the winder.

Referring to FIG. 1, the doff-don system is located adjacent to a fiber spinning area 10 in which yarn is delivered from individual spinning positions to each of a plurality of winders 11 which produce yarn packages 12 having rotational axes which are parallel to a working aisle 13. Occupying a portion of each aisle 13 is a doff-don servant 14, floor-mounted on power-driven wheels and arranged to follow a path 15 in a closed loop completely around a given spinning machine. The servant 14 is adapted to perform a winder doff-don function in which yarn packages 12 are removed from the winders 11 and delivered by a vertical endless conveyor on the servant 14 to trollies 16 on a power-driven, overhead conveyor system 17 on which they are carried to package handling area. In the package handling area, the trollies 16 pick up empty bobbins 23 for delivery to the doff-don servant 14 and subsequent use on the winders.

Figure 2:
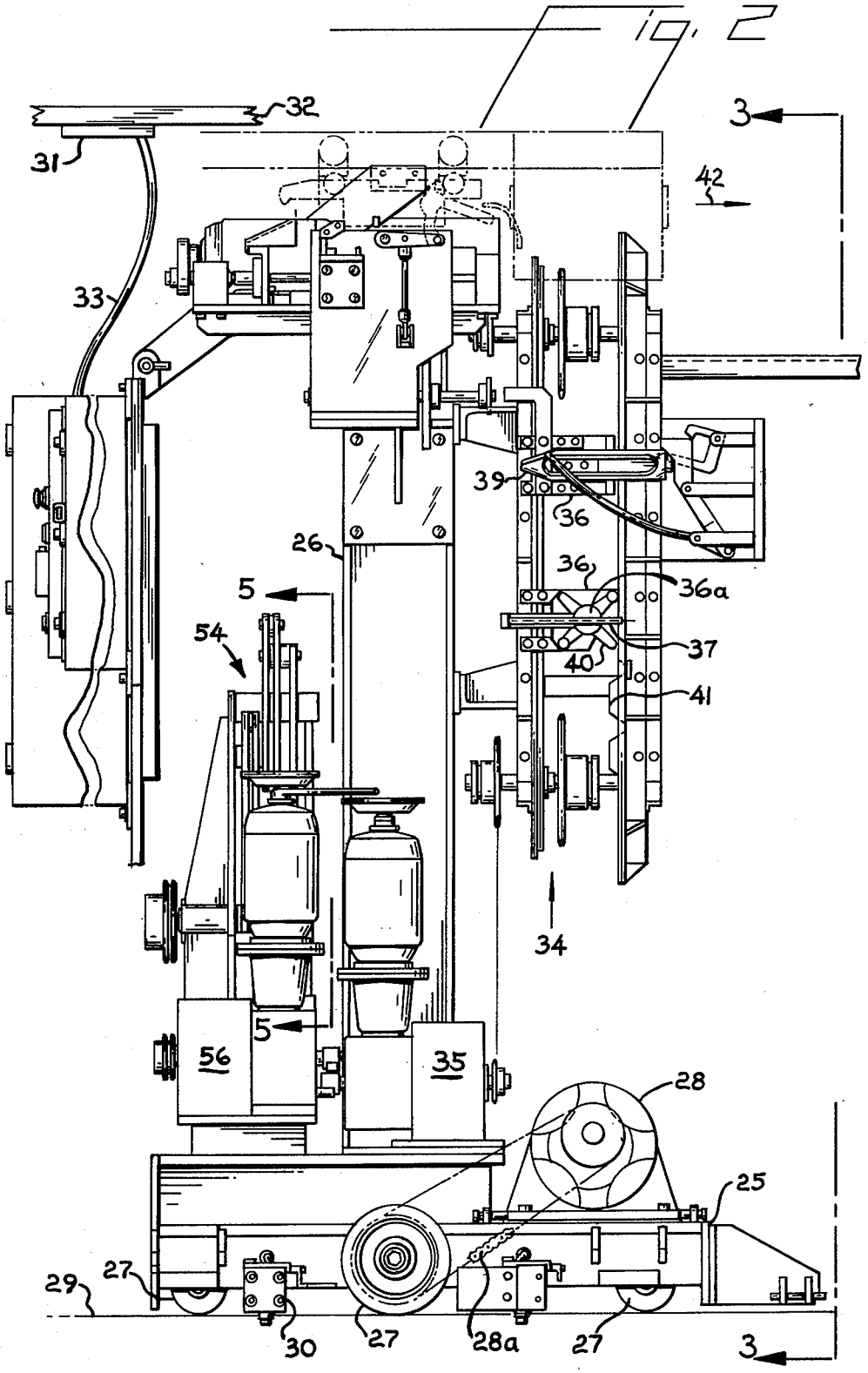
FIG. 2 is a side-elevational view of the doff-don servant.
Figure 3:
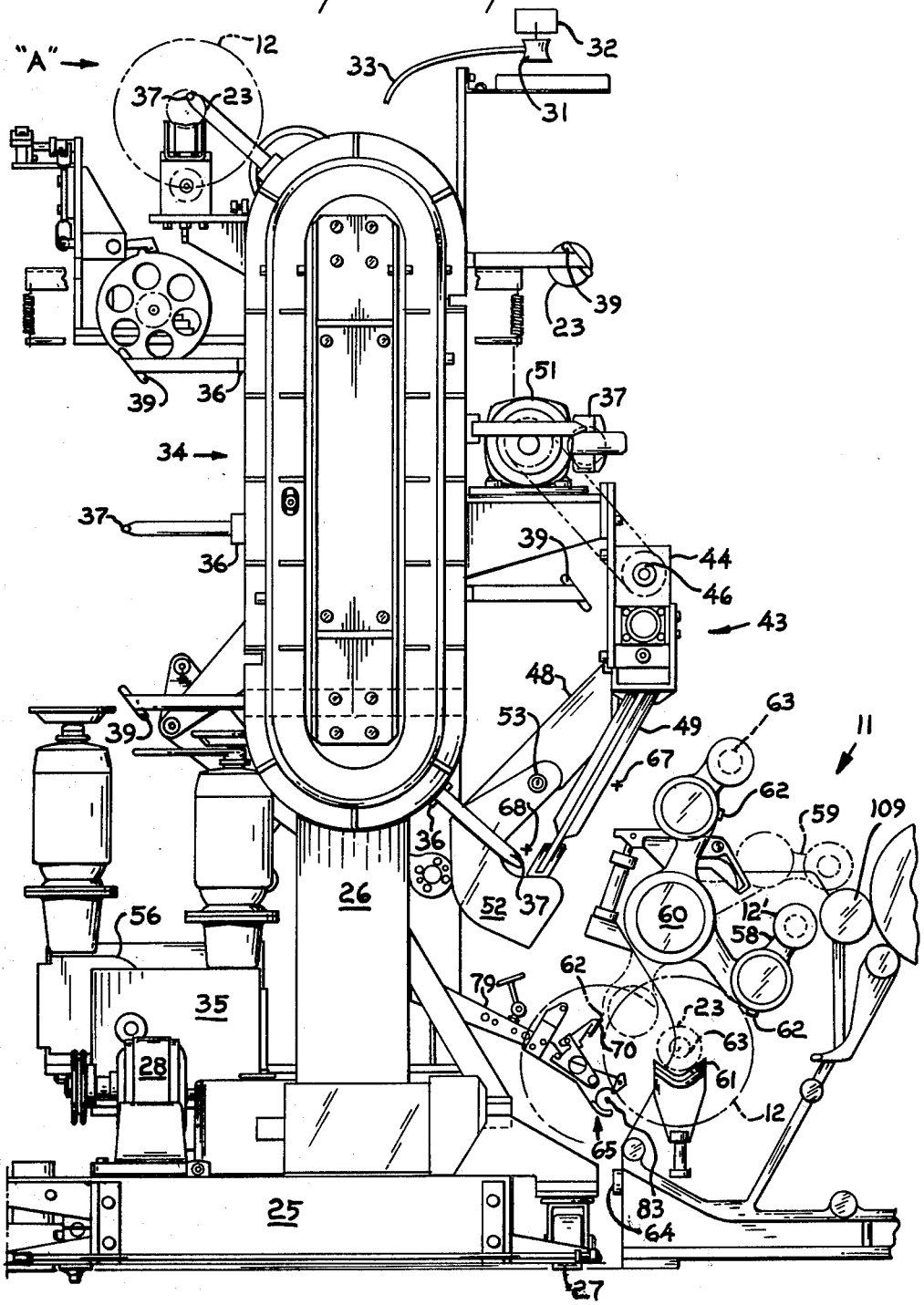
FIG. 3 is an elevational view (taken along line 3—3 in FIG. 2) and includes a side view of a winder.
Figure 4:
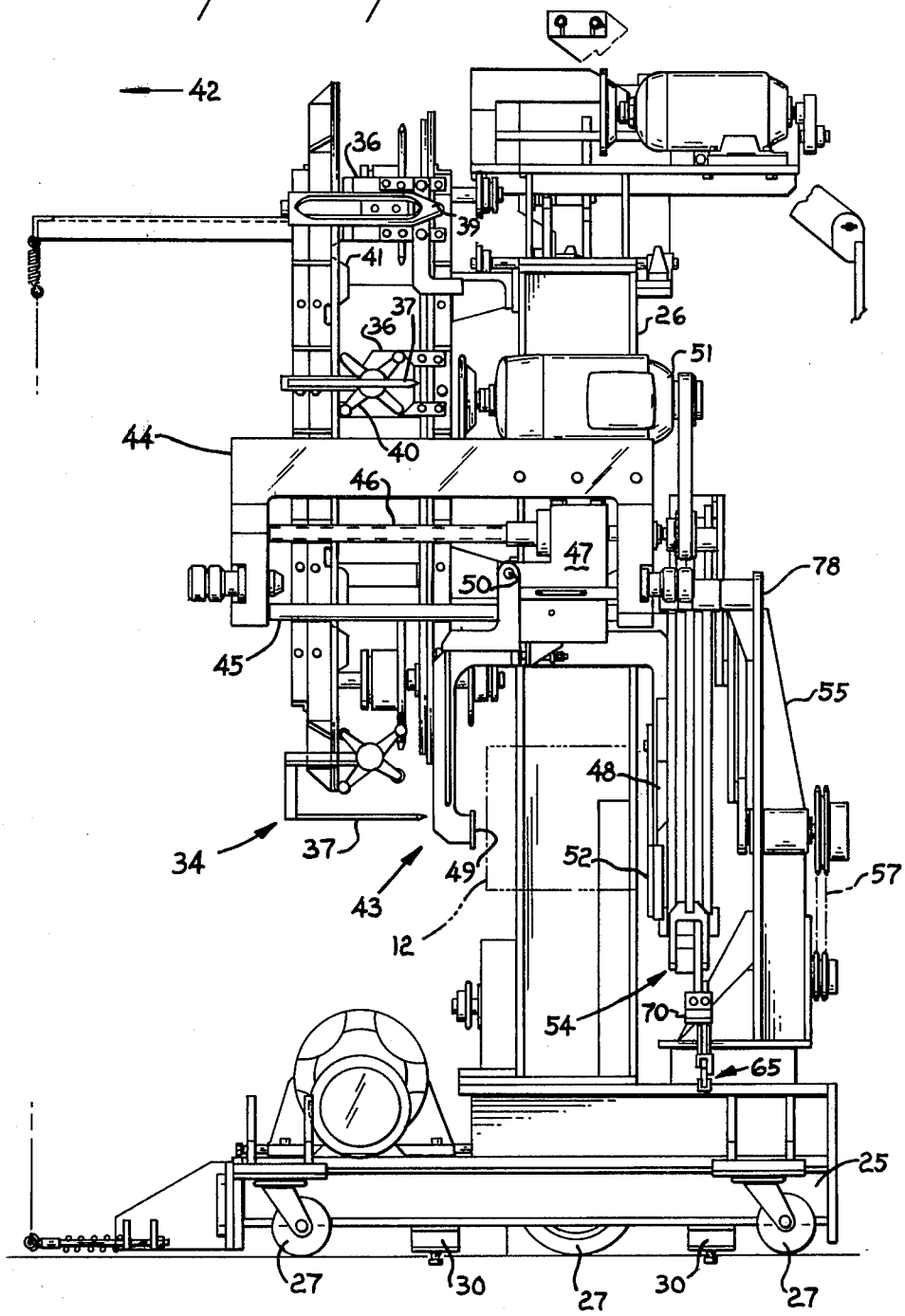
FIG. 4 is an elevational view of the doff-don servant showing the side opposite that of FIG. 2.

Referring to FIGS. 2, 3 and 4, the doff-don servant includes as major components, a frame 25, a vertical conveyor 34, a doff-don mechanism 43 and a winder manipulator 54. As best shown in FIG. 2, a post 26 is mounted to the frame 25 which is supported on the floor 29 by three wheels 27. A chain drive 28*a* connected between motor 28 and one of the wheels 27 drives the wheel to propel the unit along the floor. Locating devices 30 engage a groove in the floor and serves to cause the servant to follow the path 15 (FIG. 1) around the spinning machine. At the top, an electric cable 33, for supplying power to the servant, is joined to a movable collector 31 which engages an overhead track 32 having electrical conductors (not shown). The track encircles the spinning machine and is generally parallel with the path 15 (FIG. 1).

VERTICAL CONVEYOR

A vertical conveyor 34, shown in FIGS. 2 and 3, is mounted on the post 26 and is chain-driven from a commercial cam indexing drive 35 which serves to index a series of bobbin supports, clockwise when viewed in FIG. 3, into position to be described. Secured at intervals to the chain of the conveyor 34 are carriers 36 which have attached to them pin supports 37 (for yarn packages 12) and blade supports 39 (for empty bobbins 23) in alternating relationship around the perimeter of the conveyor. The carriers 36 have wheels (not shown) which engage tracks of the conveyor.

Figure 2A:
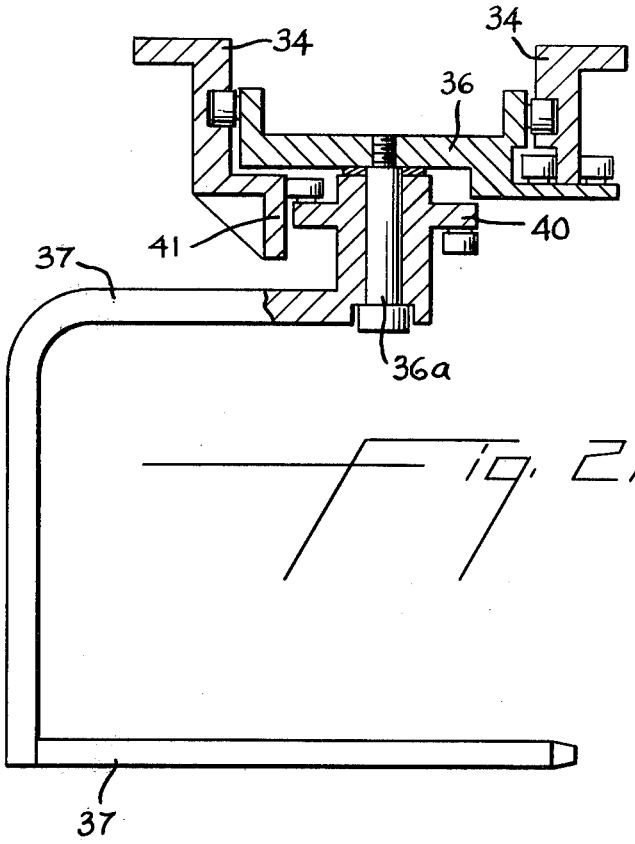
FIG. 2*a* is an enlarged top view of the conveyor mechanism.
Figure 2B:
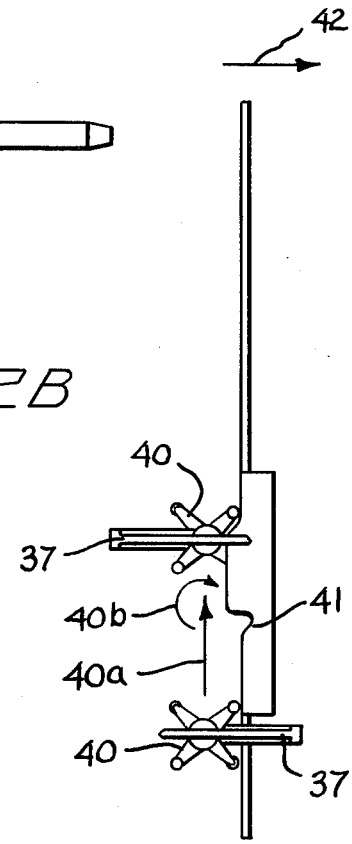
FIG. 2*b* is an enlarged partial side view of the conveyor mechanism taken from the same side as FIG. 2.

All of the pin supports 37, integrally connected to starwheel 40, are mounted rotatably on shoulder bolt pivots 36*a* which are fastened on the carriers 36 as best shown in FIG. 2*a*. Pin supports 37 are arranged to be rotated 180°, by means of a star wheel 40, in a vertical plane about the horizontal axis of pivot 36*a*. Starwheel rotation occurs at two locations, one at the lower portion of the conveyor 34 (as seen in FIG. 2) and one at the upper portion (as seen in FIG. 4). During the period of conveyor index, rollers on the star wheels engage a fixed cam 41 on the cam track causing the pin 37 to pivot 180° about pivot 36*a* from its former position so that on the side of the conveyor 34 facing the winder the end of the pin is oriented to the right, as in FIG. 4, e.g., in yarn package receiving orientation. On the opposite side of the conveyor 34 as shown in FIG. 2*b* the star wheels engage cam 41 and the pin 37, now carrying a yarn package, is again rotated 180° about pivot 36*a* so that the end of the pin is oriented in the direction of trolley travel, arrow 42. FIG. 2*b* illustrates vertical motion of the conveyor lift by arrow 40*a* and starwheel rotation of pin 37 by arrow 40*b*. When further motion of the vertical conveyor lifts the yarn package to position "A", FIG. 3, that pin orientation allows a support (not shown) carried by the trolley to enter the bobbin and carry the yarn package away for eventual delivery to the package handling area (FIG. 1).

DOFF-DON MECHANISM

Figure 6:
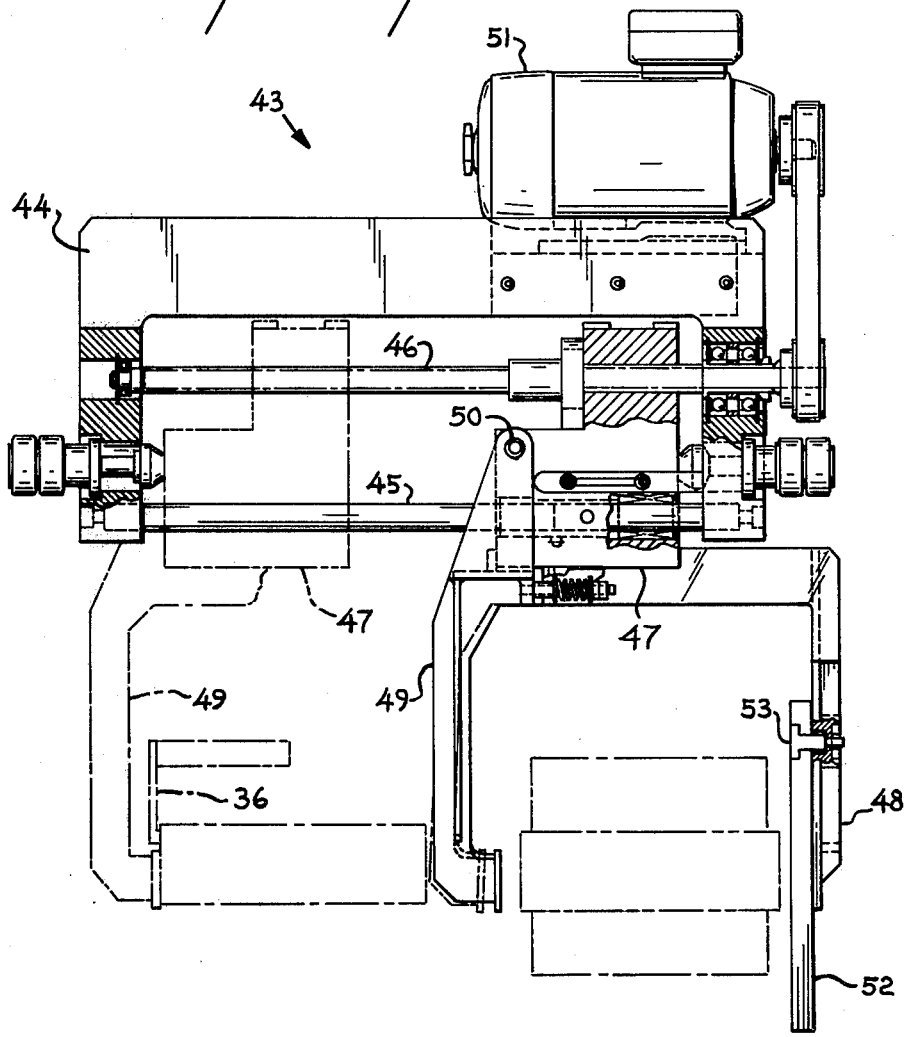
FIG. 6 is an enlarged partial view of FIG. 4 showing only the yarn package doffer.

Supported on the side of the servant facing the winder is a doff-don mechanism 43 shown in FIGS. 3, 4 and 6. This includes a bracket 44, secured to post 26, horizontal guide bar 45, a screw 46 parallel to the guide bar and a crosshead 47 carried on the screw and guide bar. Secured to one end of the crosshead 47 is a hanging doff bar 48 and secured to the opposite end of the crosshead 47, by means of a pivot pin 50, is a don bar 49. Above the bracket 44 is a motor 51 (FIG. 3) which is adapted to drive the screw 46 in either direction to propel the crosshead 47 and bars 48, 49 horizontally to the broken line position (FIG. 6) and return. Secured to the lower end of the doff bar 48 is a free swinging paddle 52 which is pivotally mounted on a pin 53. The paddle 52, as seen in FIG. 3, is generally hook-shaped, the eye of the hook having a radius slightly greater than the outside diameter of the bobbon 23.

WINDER MANIPULATOR

Figure 5:
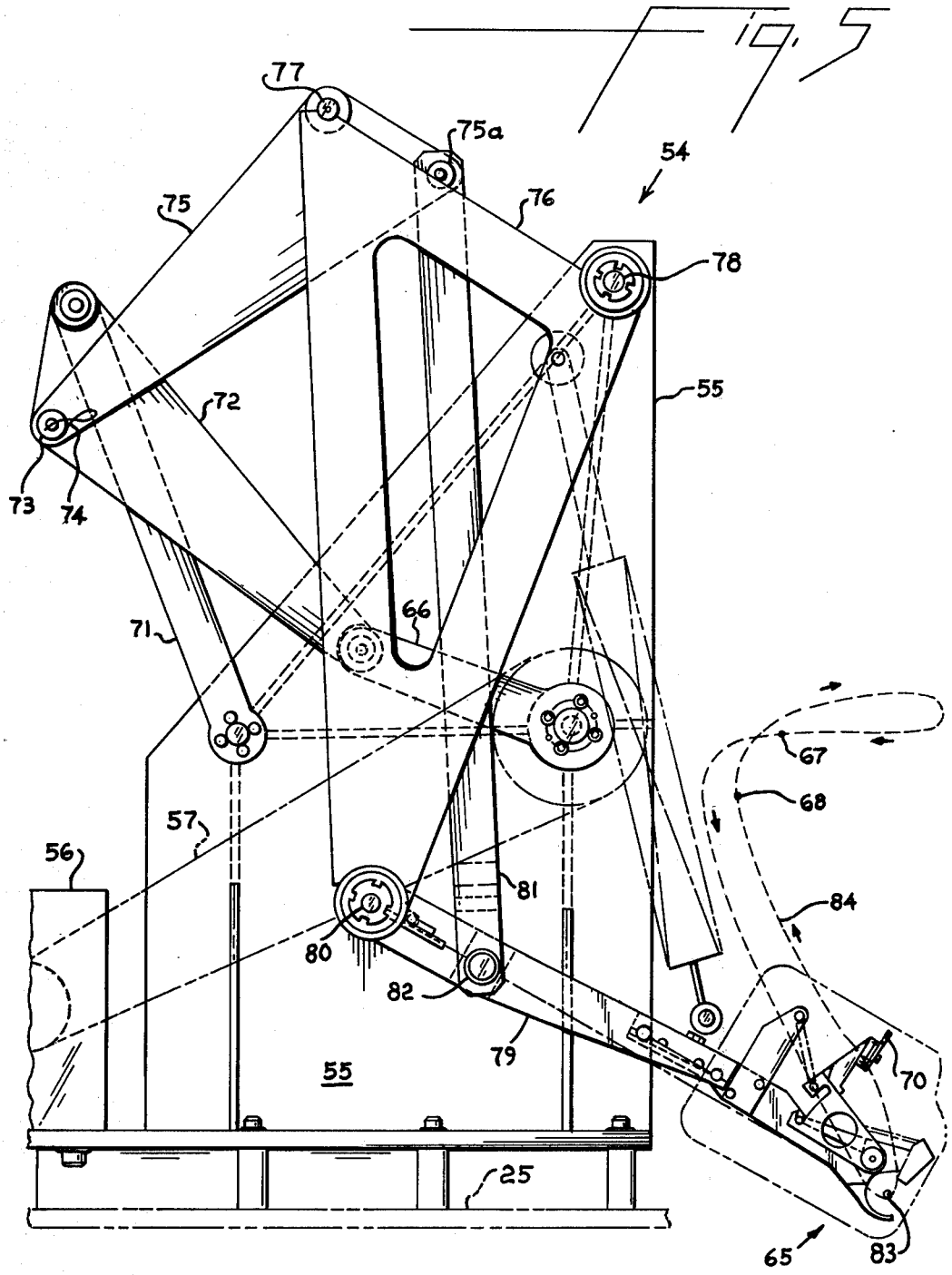
FIG. 5 is an elevational view (taken along line 5—5 in FIG. 2) of a linkage in the doff-don servant used for manipulating parts of the winder.

Referring to FIGS. 4 and 5, a winder manipulator 54 generally comprises a number of pivotally connected links supported by a vertical frame 55 on the main frame 25. The links are driven by means of a motor-reducer-cam drive combination 56 (FIG. 3) and chain drive 57 connected to the crank 66 which rotates (clockwise in FIG. 5) in 180° increments to drive the links and thus the gripper 65 to two different dwell positions (FIG. 3), a "park" position 67 and a doff-don position 68. These positions (67, 68) represent the positions of axis 83 of the semicircular aperture in the gripper 65 and since the gripper engages a roller 63 on the far side of the "forearm" swing arm 58 which is axially aligned with the chuck axis, these positions, then, also represent the position of the common axis of the chuck and package when the gripper engages the chuck. When the links of the manipulator are in motion, the first part of the manipulator to engage the winder is the blade 70 which engages a hook 62 on the swing arm (FIG. 3).

As best shown in FIG. 5, the links of the manipulator generally comprise two four-bar linkages in series, or stated differently, a first four-bar linkage drives the second. The first linkage comprises the frame 55 (as a fixed link), the crank 66, a link 71 pivotally mounted at its lower end on the frame 55 and a triangular link 72 which connects the crank 66 and pivoted link 71, respectively, at their outer ends. Thus, a point such as 73 on link 72 will define a figure-8 path 74 when driven by crank 66. The two linkages are joined by means of triangular link 75, the lower end of which is pivotally joined to the first linkage at point 73 (where it will be driven in the figure-8 path 74) while the upper end of link 75 is pivotally joined to the apex of another triangular link 76 at pivot 77. The link 76 is joined to the frame 55 at pivot 78, thus the link 76 can only oscillate in an arcuate manner about that pivot 78. At the lower end of link 76 is an arm 79 joined to it by means of pivot pin 80. A final link 81, joined to arm 79 at pivot 82, extends generally vertically so that its upper end is joined to the apex 75*a* of the triangular link 75.

The second linkage, driven by the first, drives the arm 79 and consequently the gripper 65 so that the axis 83 of the gripper aperture defines a path 84 along which are situated the park position 67 and the doff-don position 68, i.e., the two positions (not shown) at which the crank 66 is stationary after successive indexes of 180° of the crank. It should be noted that the arm 79 and gripper 65, as depicted in FIG. 5, are not in a park position 67 but merely in a position of convenience for depicting the links and the like at their lowermost condition of travel. At a point along path 84 slightly above the one shown (FIG. 5), the blade 70 encounters a hook 62 (FIG. 3) on the winder swing arm and the manipulator arm 79 then lifts the swing arm (and yarn package) free of the brake cradle 61.

WINDER

Referring to FIG. 3, the winder 11 has double articulated arms 58 and 59, the upper arms of which are mounted rotatably on a common pivot 60. As described in more detail in U.S. Pat. No. 3,310,247, one arm 58 is in the winding mode while the other arm 59 is in the park position pending initiation of doff and string-up to an empty bobbin. When the yarn package 12 reaches a desired size, the arms 58 carrying the yarn package automatically descend, placing part of the chuck in a cradle 61 while substantially simultaneously effecting string-up of the chuck on arm 59 to initiate winding thereon (by means of the mechanism of U.S. Pat. No. 3,310,247). This functioning of the winder is essentially independent of the actions of the doff-don servant of the present invention; however, the "rest" position of the winder arms and yarn package 12 as supported in brake cradle 61 (FIG. 3) is of importance since it is at this location that the manipulator gripper 65 engages the winder to start the doff-don cycle. The winder was modified by the addition of a hook 62 to the side of each "upper arm" swing arm positioned to be engaged by the blade 70 of the manipulator.

CONTROLS

Figure 7:
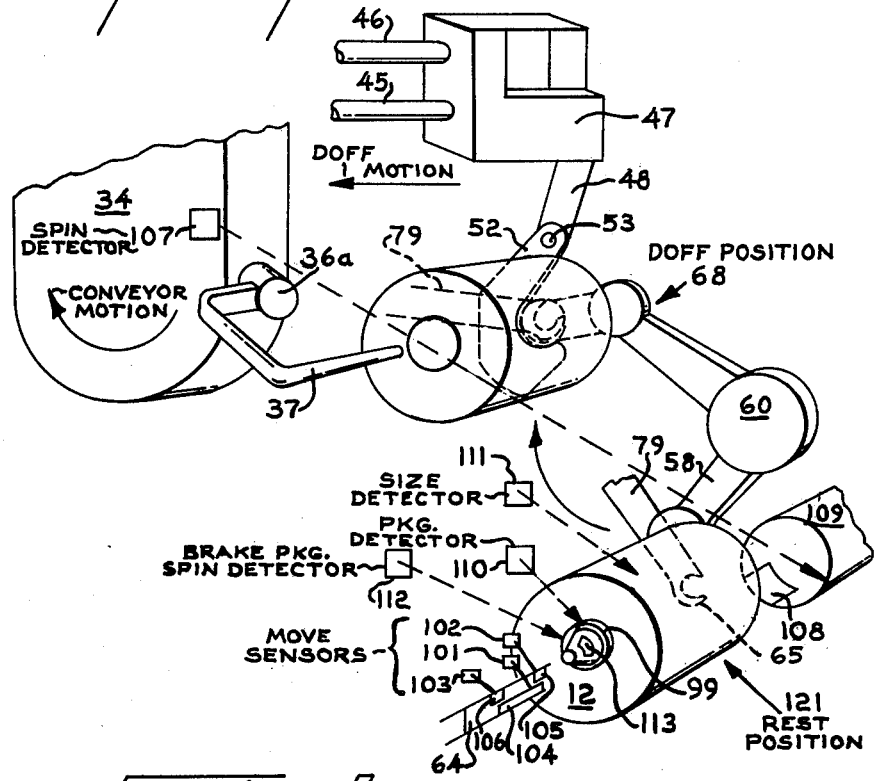
FIG. 7 is a schematic view, in perspective, representing the doffing operation.

The controls for the doff-don servant 14 are shown as a block diagram in FIG. 9. Microcomputer 100 supplies signals to motor control 114 to energize drive motor 28. Three move sensors 101, 102 and 103 supply inputs to the microcomputer from reflective strips 104, 105 and 106 (FIG. 7). The sensors 101, 102 and 103 are Banner model No. SM512LAFO.

Four other sensors 107, 110, 111 and 112 provide inputs to the microcomputer 100 for determining if the package is in condition for doffing. Sensors 107 and 112 are Automatic Timing and Controls Co. Model 7054, while sensors 110 and 111 are Scientific Technology Inc. Model AL3093. Windup spin detector sensor 107 is used to detect if the winder has ceased operation. Package detector sensor 110 detects if a package is indeed present for doffing. Size detector sensor 111 detects if the size of the package is greater than 10 inches. Brake package spin detector sensor 112 is used to detect if the bobbin is spinning.

After having satisfied the above conditions for package readiness for doffing, microcomputer 100 signals motor control 115 to energize motor 56 to operate winder manipulator 54. After the winder manipulator moves a package to the doff position 68, position sensor 117 (e.g., Industrial Solid State Controls Inc. Model No. 9801-16) senses if manipulator arm 79 is in the doff position while position sensor 118 (Industrial Solid State Controls Inc. Model No. 9801-16) senses if a package is in position. With these conditions met, microcomputer 100 signals motor control 116 to energize motor 51 which causes doff paddle 52 to operate. After package 12 is doffed, microcomputer 100 signals motor control 119 to energize motor 35 in order to index vertical conveyor 34. Subsequent to indexing, microcomputer 100 signals motor control 116 to energize motor 51 which causes the don bar 49 to don empty bobbin 23. Position sensor 120 (Banner Model No. SM512DA) senses that empty bobbin 23 has been donned on chuck 99 and microcomputer 100 again signals motor control 115 to energize motor 56 so that manipulator arm 79 can move chuck 99 to park position 67.

OPERATION

Figure 8:
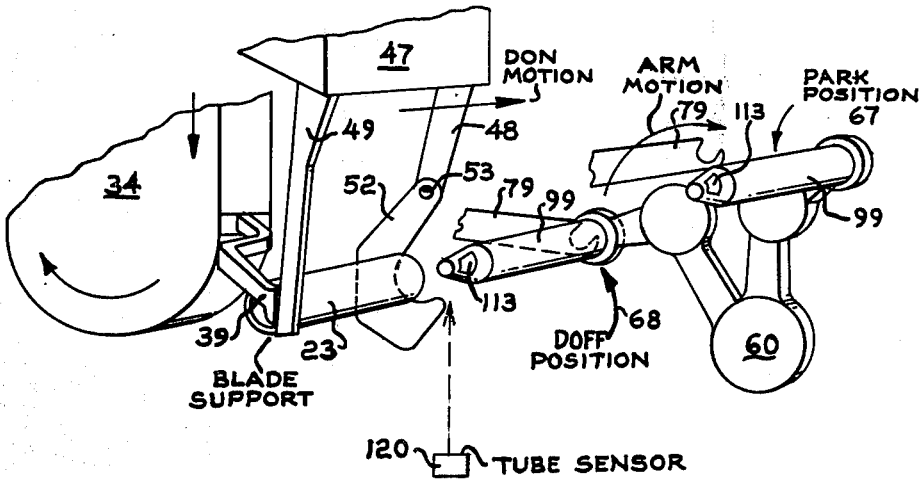
FIG. 8 is a schematic view, in perspective, representing the donning operation.

In operation, upon a signal from the microcomputer 100, a chain drive from motor 28 drives wheel 27 and propels doff-don servant 14, which with the aid of locating devices 30 follows path 15 around the spinning machine (FIG. 1). The doff-don servant 14 carries light sources (not shown) which project light via optical fibers. Referring now to FIGS. 7, 8, and 9, as the servant 14 approaches the winder, three move sensors (101, 102, and 103) on the servant sense reflected light from three strips of reflective tape (104, 105, and 106) positioned on stop bar 64 fixed to the winder. Upon sensing the first reflective strip 104, the microcomputer 100 signals for controlled deceleration of the unit. Upon sensing the second reflective strip 105, the servant 14 is braked. The third reflective strip 106 allows the third sensor 103 to determine if the servant 14 is correctly positioned. If the servant is undertraveled, the unit has the ability to creep into position. If the servant is overtraveled, the servant will perform a special error sequence and then proceed on to the next winder. Upon correct positioning of servant 14, an optical sensor 107, e.g., the windup spin detector sensor, is used to determine whether a winder is in operation by detecting light pulses from reflective tape 108 fixed on the inside of the drive roll 109 of the winder.

Further, upon correct positioning of servant 14, other electro-optical sensors 110, 111, and 112 determine whether a yarn package 12 is present in the rest position 121 in cradle 61 of the winder, ascertain package size, and determine whether the package is still rotating. The servant will proceed to doff a full size package if the bobbin is spinning at less than 40 r.p.m. Spin detection is made possible by the use of reflective tabs 113 on the cone of the winder chuck 99. Light pulses from these tabs are optically sensed.

When a package 12 of proper location, size, and speed is detected by servant 14 in cradle 61 in the rest position 121, manipulator arm 79 is directed by the microcomputer 100 to engage blade 70 in hook 62 on the winder swing arm allowing gripper 65 to grab cam follower 63 of the chuck 99 with package 12 on it. Once the gripper 65 grabs the chuck 99, blade 70 disengages from hook 62, manipulator arm 79 then lifts the chuck 99 with package 12 up to doff position 68. Gripper 65 holds the chuck 99 in place while the doff-don operation occurs.

Subsequently, doff paddle 52 and doff bar 48 suspended at a 1 degree angle from crosshead 47 swings into position and bears up against the flat surface of yarn package 12 to push the package with oscillating force onto pin support 37 of vertical conveyor 34. In this operation motor 51 drives screw 46 and propels crosshead 47 with bars 48 and 49 to the don position. The oscillating force is achieved due to the difference in the modulus of elasticity between the steel doff bar 48 and the aluminum doff paddle 52 and because of the angle of suspension. The force oscillates from the top to the bottom of the flat surface of the package.

The vertical conveyor 34 indexes one position moving doffed package 12 out of the way in order to present empty bobbin 23 on blade support 39 for donning. Don bar 49 bears against empty bobbin 23 and pushes it onto the chuck 99. Manipulator arm 79 then throws the chuck 99 out of doff position 68 to park position 67 where gripper 65 releases cam follower 63 of the chuck 99. The servant 14 then moves to the next winding position. As doffed package 12 is indexed on vertical conveyor 34, pin support 37 is pivoted 180° so that the end of the pin is oriented in the direction of trolley travel. When further motion of the vertical conveyor 34 lifts yarn package 12 to position "A" (FIG. 3), that pin orientation allows a support carried by the trolley 16 to enter the bobbin and carry yarn package 12 away for eventual delivery to the package handling area.

Although the embodiment in FIG. 6 describes a crosshead 47 driven by screw 46, the crosshead 47 may preferably be driven by a ROH'LIX* linear actuator (Zero Max Model No. 4011).

*Trademark

We claim:

1. In a winding apparatus having a plurality of windups, each windup including a drive roll, a pair of rotatable chucks carrying yarn support bobbins alternately movable from a park position into surface driven engagement with the drive roll then to a rest position, and a pair of articulated swing arms for moving the bobbins through said positions, an apparatus for doffing yarn packages from the chucks and donning empty bobbins on the chucks, said apparatus comprising:

(a) a frame mounted for movement into a position adjacent each windup;

(b) a gripper to engage said swing arms when in the rest position;

(c) means connecting the gripper and the frame for moving the gripper into engagement with said arms and moving the gripper and swing arms from the rest position first to a doff-don position then to said park position;

(d) means attached to said frame at a location adjacent said doff-don position for doffing yarn packages from the chuck and donning empty bobbins thereon following doffing when the swing arms are in the doff-don position; and (e) endless conveyor means attached to said frame for delivering doffed yarn packages from said doff-don position to a location away from said winder and for delivering empty bobbins to said doff-don position for placement on said chucks by said means for donning bobbins.

2. The apparatus as defined in claim 1, wherein said means connecting the gripper and the frame comprises two four-bar linkages in series.

* * * * *